US005548881A

United States Patent [19]

Ludwig

[11] Patent Number: 5,548,881

[45] Date of Patent: Aug. 27, 1996

[54] APPARATUS FOR NEEDLING A NONWOVEN WEB WITH A ROCKING NEEDLE BOARD

[75] Inventor: Legl Ludwig, Buchkirchen, Austria

[73] Assignee: Textilmaschinenfabrik Dr. Ernst Fehrer Aktiengesellschaft, Leonding, Austria

[21] Appl. No.: 423,012

[22] Filed: Apr. 14, 1995

[30] Foreign Application Priority Data

Apr. 28, 1994 [AT] Austria ..... 890/94

[51] Int. Cl.[6] ..... D04H 18/00

[52] U.S. Cl. ..... 28/114

[58] Field of Search ..... 28/107, 111, 113, 28/114, 115; 112/80.4, 80.42, 80.45, 271

[56] References Cited

U.S. PATENT DOCUMENTS

| | | | |
|---|---|---|---|
| 3,633,523 | 1/1972 | Card | 112/80.42 |
| 3,919,952 | 11/1975 | Lund | 112/80.42 |
| 5,186,133 | 2/1993 | Green | 112/80.42 |

FOREIGN PATENT DOCUMENTS

| | | | |
|---|---|---|---|
| 249392 | 9/1966 | Austria . | |
| 1044717 | 10/1966 | United Kingdom | 28/107 |
| 1435772 | 11/1968 | United Kingdom | 28/107 |
| 2000617 | 7/1971 | United Kingdom | 28/107 |
| 1375951 | 12/1974 | United Kingdom | 112/80.42 |

*Primary Examiner*—C. D. Crowder
*Assistant Examiner*—Larry D. Worrell, Jr.
*Attorney, Agent, or Firm*—Collard & Roe, P.C.

[57] ABSTRACT

The described apparatus for needling a nonwoven web comprises at least one needle beam for carrying a needle board, a rocker for guiding the needle beam and a slider-crank mechanism for actuating the needle beam. To effect a mass compensation it is proposed that two needle beams are arranged one behind the other in the direction of travel of the nonwoven web and are guided each by a rocker and actuated each by a slider-crank mechanism and that the two slider-crank mechanisms comprise parallel crankshafts or eccentric shafts, which are rotated in mutually opposite senses.

2 Claims, 1 Drawing Sheet

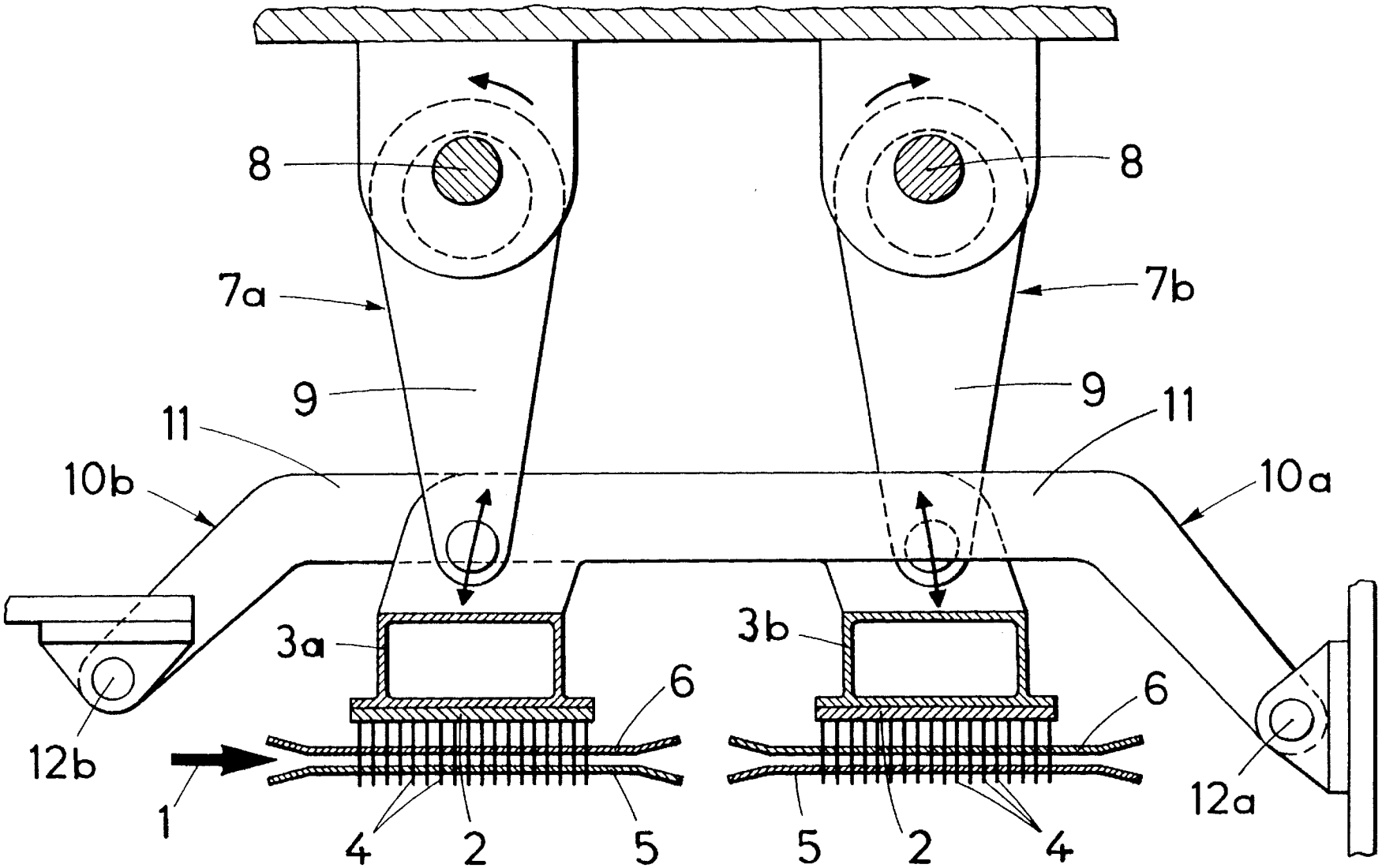
8
7b
9
11
10a
12a
6
4
2
5
3b
8
7a
9
11
10b
12b
6
5
2
4
3a
1

APPARATUS FOR NEEDLING A NONWOVEN WEB WITH A ROCKING NEEDLE BOARD

FIELD OF THE INVENTION

This invention relates to an apparatus for need-ling a nonwoven web, which apparatus comprises at least one needle beam for carrying a needle board, a rocker for guiding the needle beam, and a slider-crank mechanism for actuating the needle beam.

DESCRIPTION OF THE PRIOR ART

Needle beams which carry needle boards are generally actuated by slider-crank mechanisms, which are connected to the needle boards by push rods, which are slidably mounted in guides, or the slider-crank mechanisms are pivoted to rockers, which carry the needle beams (Austrian Patent Specification 249,392). The use of a rocker for guiding a needle beam affords the advantage that the structure is simple because there is no need for providing push rods and associated sliding guides between the connecting rods of the slider-crank mechanisms and the rocker. But a simple guidance by a rocker will result in an arcuate path for the needles and even though the length of the rocker is large relative to the oscillation amplitude that arcuate path for the needles may influence the result of the needling operation in that the nonwoven web is more effectively felted than by a needling operation in which the needles are moved along a straight path.

Regardless of whether the needle beam is guided alone a straight line or by a rocker, vibration will be generated by slider-crank mechanisms for reciprocating a needle beam. If slider-crank mechanisms are used to actuate needle beams which are moved along straight lines by means of push rods, it is known to compensate mass forces and mass moments in that the slider-crank mechanism is provided with two parallel crankshafts or eccentric shafts, which can be driven to rotate in mutually opposite senses and are connected by connecting rods to a common link, which is connected to the push rods. On principle, such a mass compensation might also be used in conjunction with needle beams guided by rockers but such an arrangement will require a higher structural expenditure so that the advantage residing in the simple design permitted by the use of such a guiding rocker will be offset to a large extent.

SUMMARY OF THE INVENTION

For this reason it is an object of the invention to ensure in an apparatus of the kind described first hereinbefore for needling a nonwoven web that the first-order mass forces and mass moments will substantially be compensated but it is not necessary to provide two slider-crank mechanisms for each needle board.

The object set forth is accomplished in accordance with the invention in that two needle beams are arranged one behind the other in the direction of travel of the nonwoven web and are guided each by a rocker and actuated each by a slider-crank mechanism and the two slider crank mechanisms comprise parallel crankshafts or eccentric shafts, which are rotated in mutually opposite senses.

Owing to the provision of two slider-crank mechanisms rotating in mutually opposite senses, it is possible in conjunction with the use of guiding rockers to compensate the first-order mass forces and mass moments to a substantial degree, which is guite comparable to the mass compensation which will be achieved if a needle beam is guided along a straight path. Whereas that result was to be expected, each slider-crank mechanism drives a separate needle beam so that not only the structural expenditure is doubled but the needling effect is doubled too and an additional advantage will be afforded that different needling conditions can be established adjacent to the two needle beams, which are arranged one behind the other in the direction of travel of the nonwoven web. Owing to said different needling conditions it may no longer be necessary to move a nonwoven web through a needling apparatus in a second pass, as may otherwise be required.

Different needling conditions may be established in that the rockers are mounted in respective needling regions at different distances from the path of travel of the nonwoven web so that the needles will be guided along different paths as they penetrate the nonwoven web. In an alternative arrangement, the Pivot for the rocker for that needle beam which is trailing in the direction of travel of the nonwoven web precedes the two needle beams and the Pivot for the rocker for the leading needle beam succeeds the two needle beams. In that case a motion having a component in the direction of travel of the non-woven web will be imparted to the needles of one needle board and a motion having component in a direction which is opposite to the direction of travel of the nonwoven web will be imparted to the needles of the other needle board.

If the crank radius or the eccentricity of at least one of the two crankshafts or eccentric shafts is adjustable, it will also be possible to influence the needling effected by a given needle board and this will also be possible if the pivot by which the connecting rods are connected to the needle beam or to the rockers are displaced in the longitudinal direction of the rocker.

BRIEF DESCRIPTION OF THE DRAWING

FIG. 1 is a schematic longitudinal sectional view showing by way of example an apparatus in accordance with the invention for needling a nonwoven web.

DETAILED DESCRIPTION OF THE PREFERRED EMBODIMENT

The illustrated apparatus comprises two needle beams, i.e. a leading needle beam 3*a* and a trailing needle beam 3*b* which are arranged one behind the other in the direction of travel 1 of the nonwoven web and each of which carries a needle board 2. The needles 4 of the needle boards 2 pierce a nonwoven web, which moves in the direction of travel 1 between a web support 5 and a stripper 6. To permit their penetration by the needles, the web support 5 and the stripper 6 consist of respective perforated plates. The needle beams 3*a* and 3*b* are actuated by two slider-crank mechanisms 7*a* and 7*b*, each of which comprise a crankshaft or eccentric shaft 8 and connecting rods 9, which are rotatably mounted on said crankshaft or eccentric shaft 8. Each of the needle beams 3*a* and 3*b* is secured to a separate rocker 10*a* and 10*b*, which comprises parallel arms 11, to which the connecting rods 9 of the associated slider-crank mechanism 7*a* and 7*b* are connected. In the illustrative embodiment the pivot 12*a* for the rocker 10*a* connected to the leading needle beam 3*a* in the direction of travel 1 succeeds the two needle beams 3*a* and 3*b*, the pivot 12*b* for the rocker 10*b* connected to the trailing needle beam 3*b* precedes the two needle beams 3*a* and 3*b*, and the oppositely extending arms 11 of the two rockers 10*a* and 10*b* are laterally spaced apart and overlap. Each of the needle beams 3*a* and 3*b* is guided by the associated rocker 10*a* or 10*b* along an arc of a circle about the pivot 12*a* or 12*b* and the needles 4 will penetrate the nonwoven web along corresponding paths. Because the slider-crank mechanisms 7*a* and 7*b* comprise crankshafts or eccentric shafts 8 rotating in mutually opposite senses, the first-order mass forces and mass moments in the entire arrangement will be compensated and the result of the needling operation will be influenced too. The provision of two needle beams 3*a* and 3*b* arranged one behind the other in the direction of travel 1 of the nonwoven web will substantially increase the needling effect and it is possible to establish different needling conditions adjacent to the two needle beams 3*a* and 3*b* because different motions can be imparted to the two needle beams by different structural means. For instance, this may be achieved in that the pivots connecting the connecting rods 9 to the associated rockers 10*a* and 10*b* are displaced along the arms 11 or the eccentricity of the crankshafts or eccentric shafts 8 may be adjusted. Alternatively, the pivots 12*a* and 12*b* may be displaced at right angles to the plane in which the nonwoven web is needled.

What is claimed is:

1. In an apparatus for needling a nonwoven web as it moves in a predetermined direction of travel, comprising needle beam means, needle board means carried by said needle beam means, slider-crank mechanism means connected to said needle beam means and comprising crankshaft means operable to actuate said needle beam means, and rocker means arranged to guide said needle beam means as needle beam means are actuated by said crankshaft means, the improvement residing in that said needle beam means comprise a leading needle beam and a trailing needle beam with respect to said direction of travel, said needle board means comprise first and second needle boards respectively carried by said leading and trailing needle beams, said rocker means comprise first and second rockers respectively connected to said leading and trailing needle beams, said slider-crank mechanism means comprise first and second slider-crank mechanisms respectively connected to said leading and trailing needle beams, and said crankshaft means comprise parallel first and second crankshafts respectively included in said first and second slider-crank mechanisms and operable to rotate in opposite senses.

2. The improvement set forth in claim 1, wherein said first rocker is mounted on a pivot succeeding said two needle beams with respect to said direction of travel and said second rocker is mounted on a pivot preceding said two needle beams in said direction of travel.

* * * * *